US009153218B1

(12) United States Patent
Micek

(10) Patent No.: US 9,153,218 B1
(45) Date of Patent: Oct. 6, 2015

(54) TONE CONTROL FOR STRING INSTRUMENTS

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 14/576,815

(22) Filed: Dec. 19, 2014

(51) Int. Cl.
*G10H 1/12* (2006.01)
*G10H 1/06* (2006.01)

(52) U.S. Cl.
CPC ..... *G10H 1/06* (2013.01)

(58) Field of Classification Search
CPC ..... G10H 1/06; G10H 1/125
USPC ..... 84/736
See application file for complete search history.

(56) References Cited

U.S. PATENT DOCUMENTS

| | | | |
|---|---|---|---|
| 2,093,245 | A | 9/1937 | Van Loon |
| 2,322,558 | A | 6/1943 | Bachman |
| 2,802,063 | A | 8/1957 | Fine et al. |
| 2,900,609 | A | 8/1959 | Estkowski |
| 3,147,447 | A | 9/1964 | Fender |
| 3,421,117 | A | 1/1969 | Grout |
| 3,449,681 | A | 6/1969 | Hafler |
| 3,472,943 | A | 10/1969 | Kawabata et al. |
| 4,151,477 | A | 4/1979 | Yokoyama |
| 4,164,163 | A | 8/1979 | Rhodes |
| 4,438,414 | A | 3/1984 | Blachot |
| 5,509,080 | A | 4/1996 | Roberts |
| 5,977,474 | A | 11/1999 | O'Brien |
| 6,034,316 | A | 3/2000 | Hoover |
| 8,766,082 | B2 | 7/2014 | Smith |
| 2003/0179893 | A1 | 9/2003 | Smith |

OTHER PUBLICATIONS

Dirk Wacker, The Fender TBX Tone Control, Part 1, Sep. 21, 2010, internet web address: http://www.premierguitar.com/articles/the_fender_tbx_tone_control_part_1.

Dirk Wacker, The Fender TBX Tone Control, Part 2, Oct. 20, 2010, internet web address: http://www.premierguitar.com/articles/The_Fender_TBX_Tone_Control_Mod_Part_2.

Joe Gore, Two-Band "PTB" Tone Control: Useful, Easy, Cheap & Awesome!, May 22, 2012, internet web address: http://tonefiend.com/guitar/two-band-ptb-tone-control-useful-easy-cheap-awesome/.

Passive Tone Controls Explained, Jul. 28, 2014, internet web address: http://www.bestbassgear.com/ebass/repair/passive-tone-controls-explained.html.

*Primary Examiner* — Jianchun Qin
(74) *Attorney, Agent, or Firm* — Rosenberg, Klein & Lee

(57) ABSTRACT

A tone control for string instruments includes a pair of potentiometers each coupled in series relationship with a respective filter capacitor. The pair of potentiometers are mechanically coupled one to the other for concurrent mechanical travel of respective displaceable contacts thereof to provide selective filtering of one or more pick-up sensors of the instrument. Responsive to selective positioning of the displaceable contacts of the pair of potentiometers, signals input thereto are high pass filtered, low pass filtered or unfiltered. The tone control can serve as a master tone control where separate tone controls are connected to series coupled pairs of pickup coils and coupled to the master tone control through a blend configuration control.

23 Claims, 9 Drawing Sheets

TONE CONTROL FOR STRING INSTRUMENTS

BACKGROUND OF THE INVENTION

This disclosure directs itself to a tone control for string instruments that permits selective filtering of one or more pickup sensors, active or passive, of the instrument. More in particular, the disclosure is directed to a tone control for string instruments that includes a pair of potentiometers each coupled in series relationship with a respective filter capacitor and mechanically coupled one to the other for concurrent mechanical travel of respective displaceable contacts thereof. Still further, the disclosure is directed to a system where responsive to selective positioning of the displaceable contacts of the pair of potentiometers, the signals input thereto are high pass filtered, low pass filtered or unfiltered. The disclosure is also directed to a tone control that operates with two pickup coils coupled in series to provide low pass filtering of one pickup coil and a high frequency boost for the other pickup coil.

Electric string instruments, such as electric guitars, electric bases, electric violins, etc., use one or more pickup sensors to convert the vibration of instrument's strings into electrical impulses. The most commonly used pickups uses the principle of direct electromagnetic induction. The signal generated by the pickup is of insufficient strength to directly drive an audio transducer, such as a loudspeaker, so it must be amplified prior to being input to the audio transducer.

Because of their natural inductive qualities, all magnetic pickups tend to pick up ambient electromagnetic interference (EMI) from electrical power wiring in the vicinity, such as the wiring in a building. The EMI from a 50 or 60 Hz power system can result in a noticeable "hum" in the amplified audio by from the audio transducer, particularly with poorly shielded single-coil pickups.

While most single coil pickups are wired in parallel with each other, it is also possible to wire them in series, producing a fuller and stronger sound. Using a multiple pole, multiple through switch, such as a double pole, double through switch (DPDT) or double pole three position switch, it is known in the art to switch the coil configuration between series and parallel, and may also provide or "coil cut" configuration (a single coil output). It is also known to use ganged potentiometers to provide series to parallel blending.

Networks formed by ganged or individual potentiometers with series coupled capacitors for "treble control" and parallel coupled capacitors for "bass control" have been used for many years. However, such controls do not give the musician the option for a natural unfiltered sound without the use of a switch to bypass the tone control network. It is an object of the invention disclosed herein to overcome that and other deficiencies in the prior art

SUMMARY OF THE INVENTION

A tone control for string instruments is provided. The tone control includes a pair of potentiometers each having one end coupled in series relationship with a respective filter capacitor and mechanically coupled one to the other for concurrent mechanical travel of respective displaceable contacts thereof. A first of the pair of potentiometers and the series coupled filter capacitor are connected between a pair of input terminals. The displaceable contact of the first potentiometer is connected in common with a second end of the potentiometer. The filter capacitor coupled in series with the second of the pair of potentiometers is coupled in common with the displaceable contact of the first potentiometer and in common with a second end of the second potentiometer. The displaceable contact of second potentiometer is coupled to an output terminal. By that arrangement, a high pass filter is formed at one end of the concurrent mechanical travel, a low pass filter is formed at an opposing end of the concurrent mechanical travel, and an unfiltered path between the input terminals and the output terminal is formed at an intermediate position of the concurrent mechanical travel.

From another aspect, a tone control for string instruments is provided. The tone control includes a pair of input terminals coupled to at least one vibration sensing pickup disposed on a string instrument. The tone control also includes a first potentiometer having a first resistive element coupled between first and second terminals thereof. The first potentiometer has a first displaceable contact connecting to the first resistive element and a third terminal. The first terminal is coupled to one of the pair of input terminals and the third terminal is electrically coupled to the first terminal of the first potentiometer. Further, the tone control includes a first filter capacitor having opposing first and second terminals thereof being coupled in series relationship with the first resistive element between the pair of input terminals, one of the first and second terminals of the first filter capacitor being coupled to one of a pair of output terminals. The tone control further includes a second potentiometer having a second resistive element coupled between first and second terminals thereof and having a second displaceable contact, the first and second potentiometers being mechanically coupled for concurrent mechanical travel of the first and second displaceable contacts. Still further, the tone control includes a second filter capacitor having opposing first and second terminals being coupled in series relationship with the second resistive element. The first terminal of the second filter capacitor is electrically connected to the first terminal of the first potentiometer. The second displaceable contact is coupled to the other of the pair of output terminals. By that arrangement, the first and second potentiometers provide different filter selections responsive to the positioning of the first and second displaceable contacts along the concurrent mechanical travel thereof for (a) forming a high pass filter at one end of the concurrent mechanical travel, (b) forming a low pass filter at an opposing end of the concurrent mechanical travel, and (c) forming an unfiltered path between the pair of input terminals and the pair of output terminals at an intermediate position of the concurrent mechanical travel.

Additionally, each of the first and second potentiometers has a substantial resistance between the intermediate position and one of the ends of the concurrent mechanical travel of the first and second displaceable contacts, and an insignificant resistance between the intermediate position and the other of the ends of the concurrent mechanical travel of the first and second displaceable contacts.

From yet another aspect, a tone control for string instruments is provided that includes a pair of pickup coils disposed on a string instrument for inducing voltages therein responsive to vibration of at least one string of the string instrument. The pair of pickup coils are coupled in series relationship. Further, the tone control includes a high frequency bypass circuit coupled in parallel with one of the pair of pickup coils for filtering signals from the pair of pickup coils. The high frequency bypass circuit forms a low pass filter for the one of the pair of pickup coils and a high pass filter for the other of the pair of pickup coils.

Additionally, the high frequency bypass circuit includes a capacitor coupled in parallel relationship with the one of the pair of pickup coils, or the series combination of a variable resistor and a capacitor coupled in parallel relationship with the one of the pair of pickup coils to vary an effect of filtering provided by the capacitor, or the series combination of a switch and a capacitor coupled in parallel relationship with the one of the pair of pickup coils to selectively couple the capacitor to the one of the pair of pickup coils.

DETAILED DESCRIPTION OF THE PREFERRED EMBODIMENTS

Figure 1:
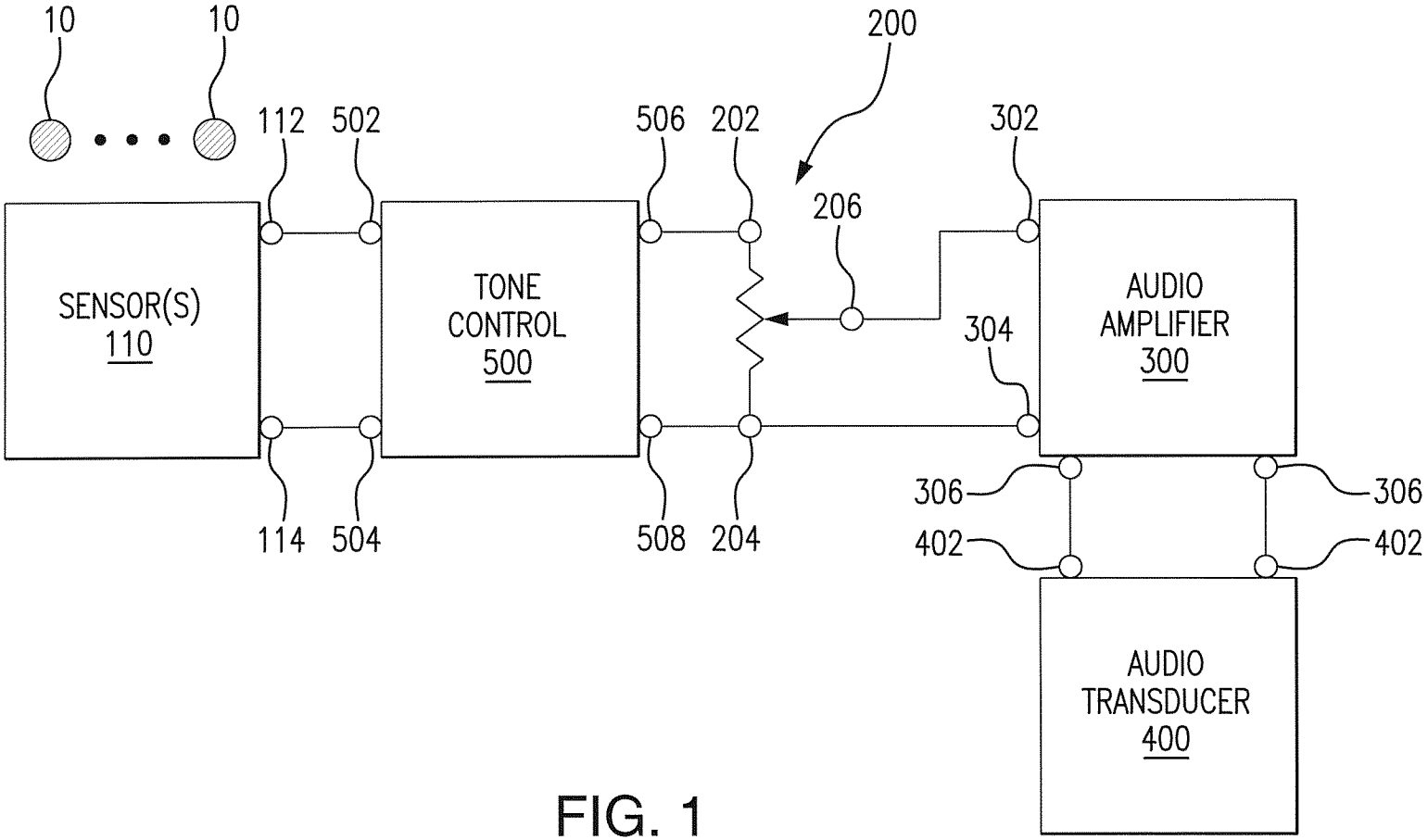
FIG. 1 is a block diagram illustrating the basic audio system for an electric string instrument incorporating the tone control of the present invention.

Referring to FIGS. 1-12, there is shown tone control 500, 660 for use with an electric string instrument. Electric string instruments, such as electric guitars, electric bases, electric violins, etc. are usable with tone control 500, 660. Tone control 500 provides selective variation of the filtering applied to the output signals generated by the vibration sensing pickup devices of the electric string instrument. Tone control 500 can be used with electric string instruments incorporating blend configuration control 100 which provides selective variation of the electrical configuration of a pair of pickup coils of respective sensors 710 and 720, between being connected in series and being connected in parallel, as well as a combination thereof, with or without the use of electrical switches to change that configuration. The filtering arrangement provided by tone control 660 provides a unique combination of high pass and low pass filtering to complement the location of the pickup coils 710 and 720 of the electric string instrument 700 and provide a variation of sound from rock to jazz. Multiples of tone control 660, each associated with a Humbucker type pickup, can be combined using a blend configuration control 100 whose output is coupled to the tone control 500. In this configuration, tone control 500 acts as a master tone control.

As is known in the art, one or more pickup sensors are positioned in correspondence with the strings of the instrument so that they are able to produce an electrical signal in response to vibration of at least one of the multiple strings of the instrument. The sensors may be piezoelectric devices, optical sensors, microphones or the more commonly used magnetic pickup coils. Humbucker type pickups are often used with electric string instruments because they provide for cancellation of electromagnetic interference (EMI), such as the 50 or 60 Hz "hum" that is induced from nearby electrical power wiring. Humbucker type pickups typically have two pickup coils in a single package that are phased to provide cancellation of "out of phase" signals. A pair of separately located single coils can also be connected with opposing respective phases to provide cancellation of EMI. Tone control 500, 660 may be used with a pair of collocated coils as well as separately located coils in any phase relationship and located anywhere along the longitudinal extent of the strings on the instrument. They may be phased to provide noise cancellation or not, without departing from the inventive concepts embodied in tone control 500, 660. In particular, tone control 500 can be used to alter the filtering of signal frequencies provided by active or passive sensors and may be used in combination with any sensor switching or blend controls that are used to select or mix the signals from the sensors. Further, tone control 500 may be used in combination with other tone controls to function as a master tone control.

Referring now to FIG. 1, there is shown a block diagram of the basic audio system for an electric string instrument that incorporates the novel tone control 500 disclosed herein. One or more sensors 110 generate voltage signals responsive to the vibrational movement of the strings 10 of a stringed instrument, such as guitars, violins, cellos, harps, banjos, mandolins, bases, etc. The sensors may be any type capable of detecting vibration of the strings of the instrument, including piezoelectric devices, optical sensors, microphones or magnetic pickup coils. The generated signals are output to terminals 112 and 114, which are respectively connected to terminals 502 and 504 of tone control 500. As will be described in following paragraphs, tone control 500 applies different filter selections responsive to the selective positioning of potentiometer displaceable contacts. From tone control 500, the signal is output to terminals 506, 508 which are respectively connected to terminals 202 and 204 of a volume control 200. Volume control 200 is a potentiometer that functions as a voltage divider with its displaceable contact connected to an output terminal 206. The signal level at the output terminal 206 relative to terminal 204 will be in relation to the resistance between those terminals with respect to the total resistance between terminals 202 and 204. The output of volume control 200 provided from terminals 206 and 204 are respectively coupled to terminals 302 and 304 of an audio amplifier 300.

Although not illustrated in FIG. 1, it has been common to add various additional tone controls between the output of volume control 200 and the input of audio amplifier 300, in the form of resistance-capacitance (RC) filters where the resistance element is a potentiometer. While they may still be used in that fashion in combination with tone control 500, they may also be utilized instead between sensors 110 and tone control 500, making tone control 500 the master tone control for the instrument. Audio amplifier 300 increases the signal level, voltage and current, sufficiently to drive an audio transducer 400, such as headphones or one or more speakers.

The output terminals 306 of audio amplifier 300 are connected to the input terminals 402 of audio transducer 400. Although, audio amplifier 300 is shown with a single pair of output terminals, it should be understood that multiple separate outputs may be provided to simultaneously drive a plurality of audio transducers 400.

Figure 1A:
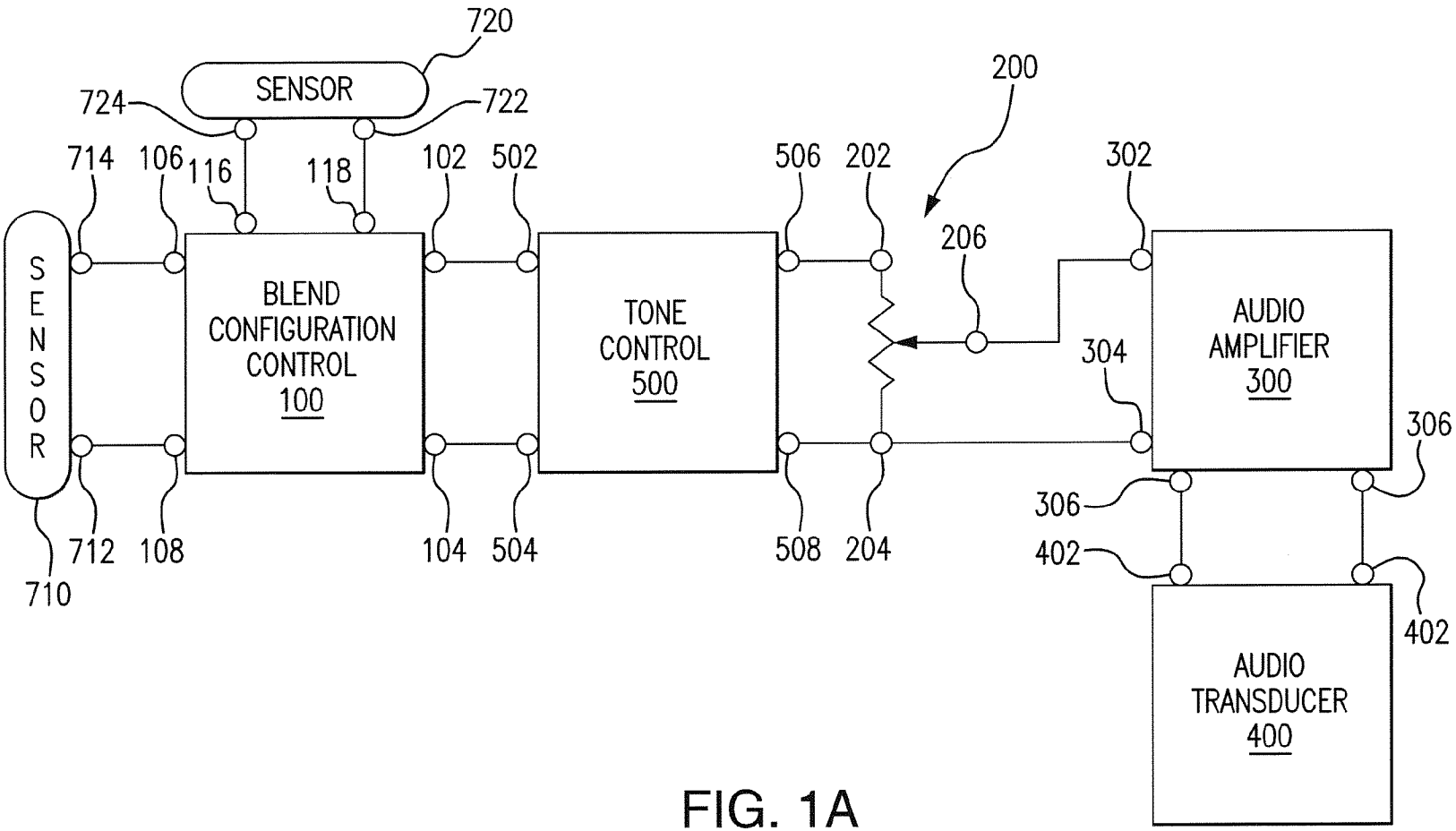
FIG. 1A is block diagram illustrating the basic audio system for an electric string instrument incorporating a tone configuration control and the tone control of the present invention.

FIG. 1 illustrates the most basic of setups for an electric string instrument. FIG. 1A shows another basic, yet somewhat more complex, setup. Illustrated here, is a block diagram of another audio system for an electric string instrument that incorporates a blend configuration control 100 and combines or selects signals from the multiple pickup coil sensors 710 and 720 to obtain a variation of sounds from the instrument. The multiple coils 710 and 720 can be combined in series, parallel or a combination thereof or an individual coil selected, using switches, potentiometers or combinations thereof. Modern electric string instruments, typically incorporate multiple Humbucker type pickups, for example one located near the bridge of the instrument and another near the neck of the instrument, with blend controls being included to mix the signals from those pickups. String instruments with three or four such pickups and a blend control to combine them are not unheard of and usable with the tone controls disclosed herein. Each of such Humbucker type pickups would be included in blend configuration control 100. Blend configuration control 100 generates voltage signals responsive to the vibrational movement of the strings 10 of a stringed instrument.

Each of the pickup coils 710 and 720 generate signals responsive to the vibratory displacement of the instruments strings that are output at the terminals 712 and 714, and 724 and 722, respectively. The outputs 712 and 714 are respectively coupled to input terminals 108 and 106 of blend configuration control 100. Similarly, the output terminals 724 and 722 are respectively coupled to input terminals 116 and 118 of blend configuration control 100. The generated signals from the pickup coils that are blended or selected are output to terminals 102 and 104, which are respectively connected to terminals 502 and 504 of tone control 500, acting as a master tone control, to selectively filter the signals provided thereto for providing the sound effect desired by the musician playing the string instrument. From tone control 500, the signal is output to terminals 506, 508 which are respectively connected to terminals 202 and 204 of a volume control 200. Volume control 200 is a potentiometer that functions as a voltage divider with its displaceable contact connected to an output terminal 206, as previously described.

The output of volume control 200 provided from terminals 206 and 204 are respectively coupled to terminals 302 and 304 of an audio amplifier 300 that provides an output on terminals 306 connected to the input terminals 402 of audio transducer 400. Hereto, the audio amplifier 300 increases the signal level input to terminals 302 and 304 sufficiently to drive the audio transducer 400

Figure 2:
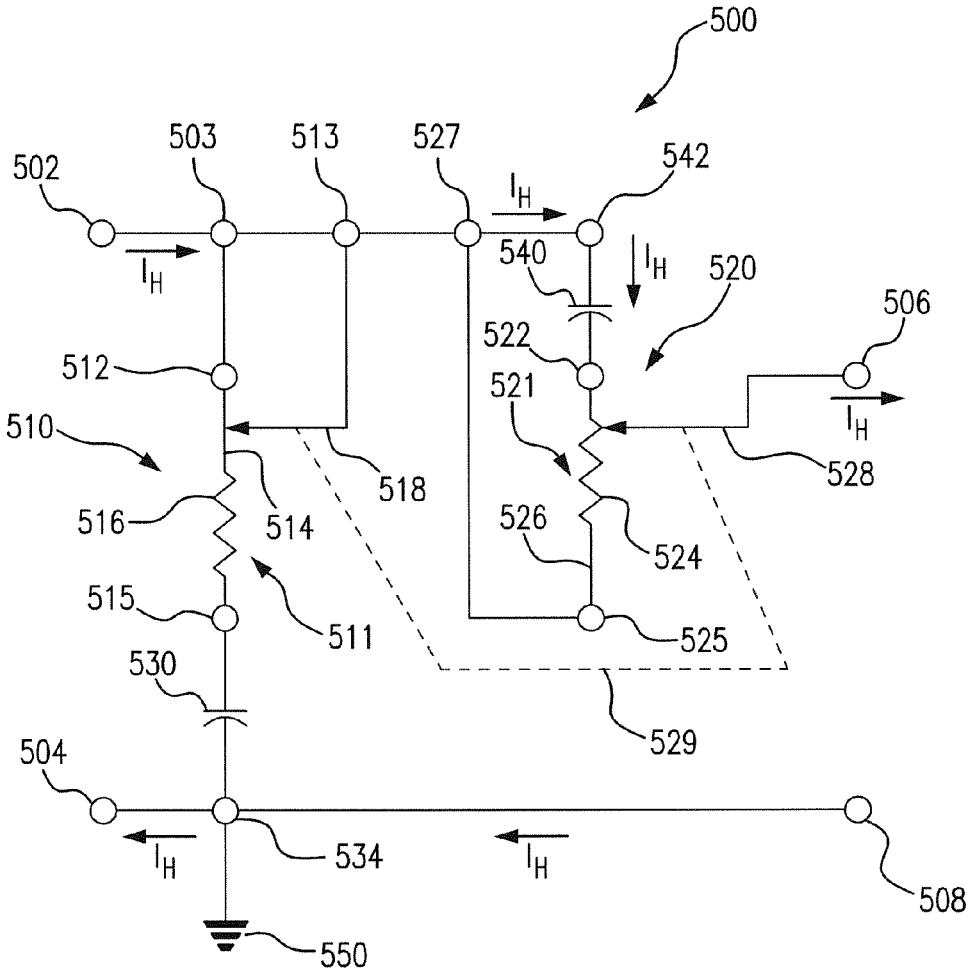
FIG. 2 is a schematic electrical diagram of the tone control of the present invention adjusted for a high pass filter configuration.
Figure 3:
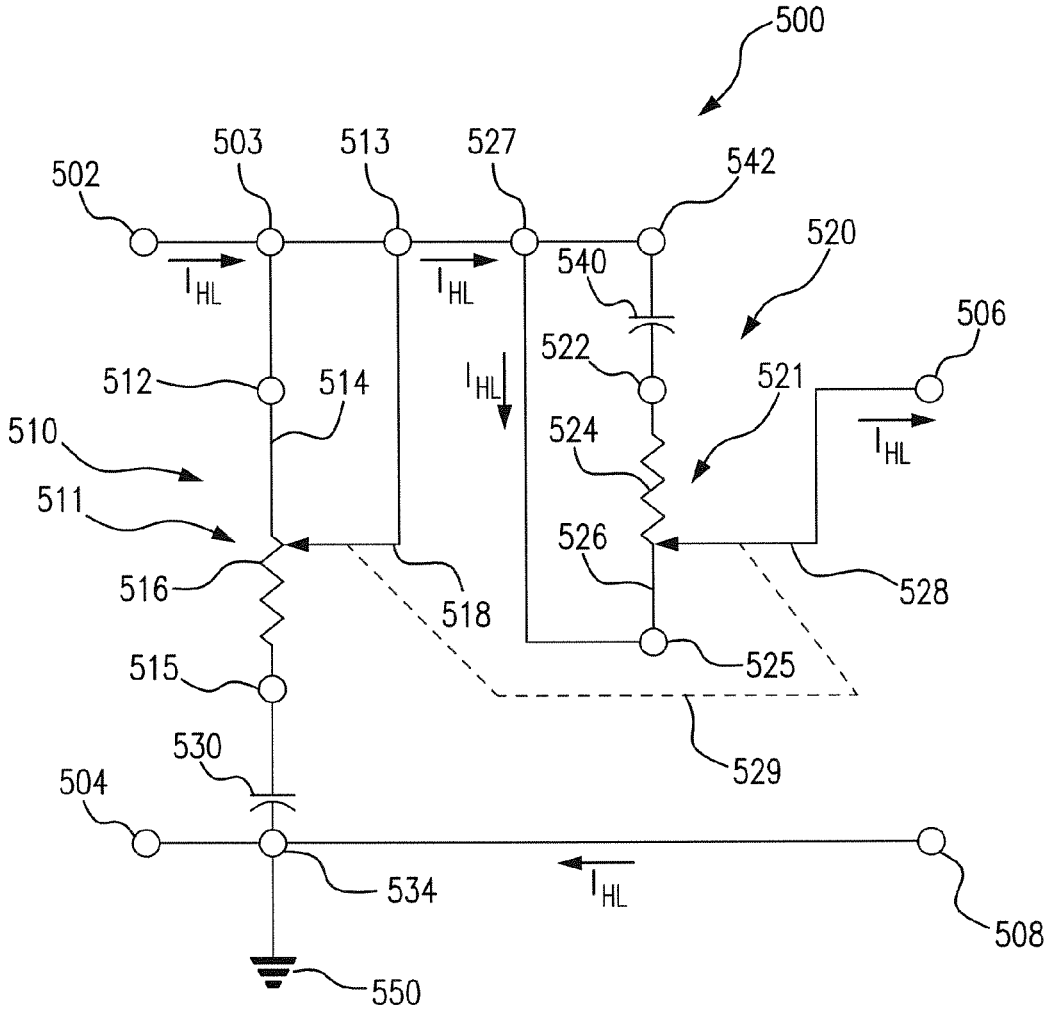
FIG. 3 is a schematic electrical diagram of the tone control adjusted for an unfiltered configuration.
Figure 4:
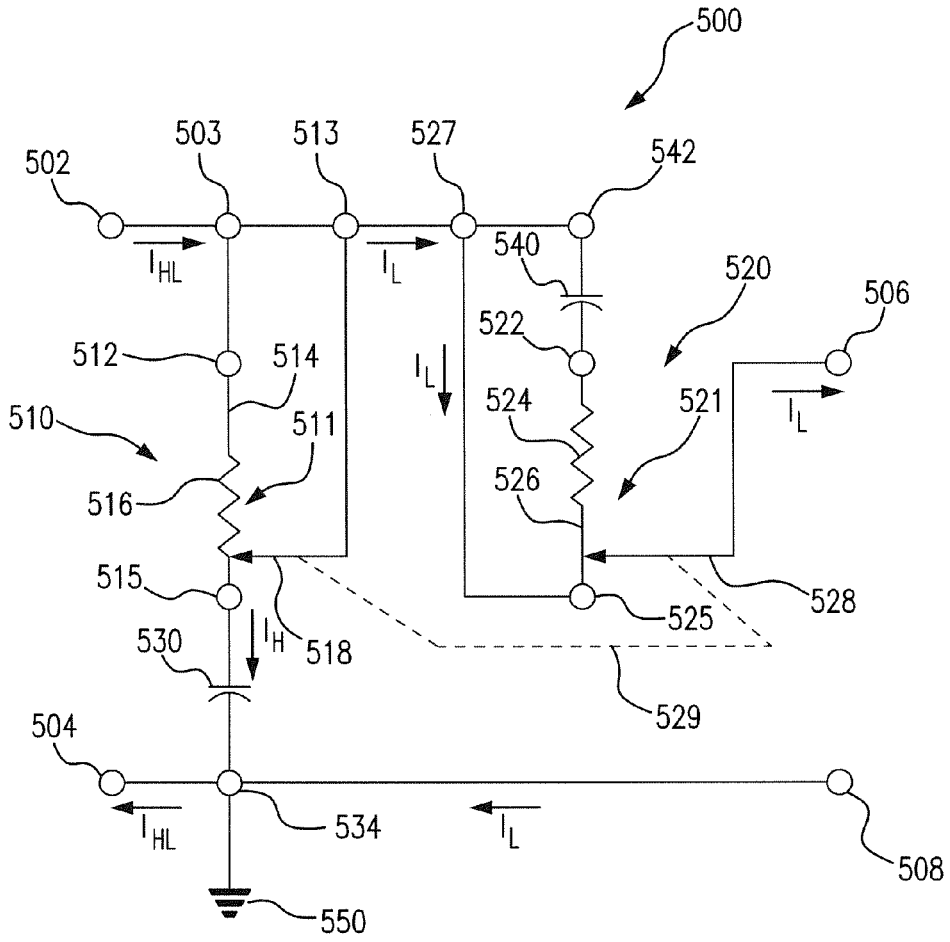
FIG. 4 is a schematic electrical diagram of the tone control adjusted for a low pass configuration.

Turning now to FIGS. 2-4, there are shown schematic diagrams of tone control 500 respectively at different settings to demonstrate the changes in filtering that is obtained therewith. Tone control 500 includes a pair of potentiometers 510 and 520 that provide the mechanism for changing the filter configuration of the pair of capacitors 530 and 540 to provide a high pass filter effect at one end of the travel of potentiometers 510 and 520, a low pass filter effect at the opposing end of the travel thereof, and an unfiltered effect at an intermediate position of the of the mechanical travel of potentiometers 510 and 520. Potentiometers 510 and 520 each include a resistive element 511, 521 connected between a respective pair of terminals 512, 515 and 522, 525, and a displace contact 518, 528 respectively coupled to an output terminal 513, 506. Potentiometers 510 and 520 are mechanically coupled together, as represented by the coupling line 529, and may be rotary or linear movement types with resistive elements 511, 521 being in the approximate range of 125 KΩ to 500 KΩ. In one working embodiment, potentiometers 510 and 520 were implemented as rotary type dual-gang potentiometers, which are two potentiometers combined on a common shaft, available from Bourns, Inc. of Riverside, Calif. and having the designation PDB182-GTRB with resistive elements 511 and 521 being 500 KΩ.

Potentiometer 510 has a resistance at 0% output at the displaceable contact 518, terminal 513, with respect to terminal 512 over the initial portion of mechanical travel of the displaceable contact 518 from the end of the resistive element 511 connected to terminal 512 defined by the element portion 514, and increases linearly (linear taper) from 0% to 100% of the resistance over the remaining portion of the travel, defined by the element portion 516. For the exemplary dual gang potentiometer identified above, the initial and remaining portions of the mechanical travel of the displaceable contacts 518 and 528 are 50% of the mechanical travel. While potentiometer 520 is constructed oppositely, with the resistance at the displaceable contact 528, terminal 506, with respect to terminal 522 decreasing linearly (linear taper) from 100% to 0% over the initial portion of mechanical travel of the displaceable contact 528 from the end of resistive element 521 connected to terminal 522 defined by the element portion 524, and remains at 0% over the remaining portion of the travel, defined by the element portion 526. In some applications the musician who owns the string instrument incorporating tone control 500 may prefer a nonlinear resistive taper, such as logarithmic taper which is also known as an audio taper, for either or both of potentiometers 510 and 520. Regardless of the taper, tone control 500 will function as described herein with respect to the filter effect at the endpoints of mechanical travel of the displaceable contacts 518, 528 and at the intermediate position of the mechanical travel where the respective element portions 514, 516 and 524, 526 join. Although, in the exemplary circuit described with respect to FIGS. 2-4 the intermediate position is in fact the midpoint of the mechanical travel, it can be located at other positions, in concert with the use of other resistive tapers or independent thereof.

Capacitors 530 and 540 may be any of a wide variety of types of capacitors, such as paper, ceramic disc, or any of a wide variety of film capacitors. Capacitor 530, as an example, may have a value in the approximate range of 22-100 nanofarads (nF), and the capacitor 540 may have a value in the approximate range of 2.2-22 nF. In one working embodiment capacitor 530 had a value of 68 nF and capacitor 540 had a value of 4.7 nF.

The following connections apply to each of FIGS. 2, 3 and 4. All of the conductors of tone control 500 represented by connections between terminals, nodes and combinations thereof may formed by conductive wires, conductive tracks on a printed circuit board, or a combination thereof. Input terminal 502 is connected to a node 503, which is in turn connected to the terminal 512 of terminal 512 of potentiometer 510. The opposing terminal 515 of potentiometer 510 is coupled to one lead of the capacitor 530. The opposing lead of capacitor 530 is coupled to a node 534. The node 534 is connected to a ground connection 550, input terminal 504 and output terminal 508 in common. Thus, the resistive element 511 of potentiometer 510 and capacitor 530 are coupled in series relationship across the input terminals 502 and 504. The terminal 513 of displaceable contact 518 is connected to the node 513. The terminal 525 of potentiometer 520 is connected to a node 527, which in turn is connected to the node 503. The opposing terminal 522 of potentiometer 520 is connected to one lead of capacitor 540. The opposing lead of capacitor 540 is connected to a node 542 that is connected to node 527. Lastly, the terminal 506 connected to the displaceable contact 528 of potentiometer 520 serves as the other output terminal of tone control 500.

The functioning of tone control 500 will now be described, beginning with the displaceable contacts 518, 528 being at a first end of their respective mechanical travel, as shown in FIG. 2. At the first end of mechanical travel, the resistance between the terminals 512 and 513, as well as between terminals 506 and 522 of displaceable contacts 518, 528 is respectively zero ohms. Due to the high resistance between input terminal 502 and the capacitor 530 the current that flows through the resistive element 511 is negligible and thus, for practical purposes no current flows through that path to capacitor 530. Thus, it can be seen that for the extent of the mechanical travel of displaceable contact 518 that it is in contact with the resistive element portion 514, no current flows to capacitor 530 and capacitor 530 is therefore ineffective in its effect on the signals input to tone control 500. Accordingly, a current $I_H$ input to terminal 502 will flow to node 542 where one lead of capacitor 540 is connected. As the capacitor represents a high impedance to low frequency signals and a low impedance to high frequency signals, capacitor 540 functions as a high pass filter. The frequency characteristic of which are determined by the capacitance value thereof and the resistance connected in series therewith by potentiometer 520.

As displaceable contact 528 of potentiometer 520 is at an end of its mechanical travel where there is essentially zero resistance in series with capacitor 540 between terminal 522 and terminal 506, the current $I_H$ flows to the output terminal 506 and of course returns to output terminal 508 to flow to input terminal 504. The current $I_H$ therefore represents the high frequency component of the signal generated by the sensors of the string instrument. As the displaceable contacts are moved along the mechanical travel thereof toward the intermediate position, resistance is added in series with the capacitor, changing the frequency response of the high pass filter represented by capacitor 540 and the portion 524 of resistive element 524.

Referring now to FIG. 3, we will examine the resulting functioning of tone control 500 when the displaceable contacts 518, 528 are positioned at the intermediate position of their respective mechanical travel, which in one working embodiment was the midpoint of the mechanical travel. When the potentiometers 510, 520 are set the intermediate point of their mechanical travel, there is zero ohms resistance between terminals 512 and 513 of potentiometer 510 and 100% of the resistance between terminals 513 and 515 thereof. Due to the high resistance between input terminal 502 and the capacitor 530 the current that flows through the resistive element 511 is negligible and thus, for practical purposes no current flows through that path to capacitor 530. Hence, at the intermediate position of the mechanical travel of displaceable contact 518, no current flows to capacitor 530 and capacitor 530 is therefore ineffective in its effect on the signals input to tone control 500.

Looking at potentiometer 520, there is 100% of the resistance between terminals 522 and 506 and zero ohms resistance between terminals 525 and 506. In this circumstance, no current flows through capacitor 540. Therefore, at the intermediate position a current $I_{HL}$ input to terminal 502 will flow to node 527, and through the conductor connected to terminal 525 of potentiometer 520. As there is zero resistance between terminal 525 and displaceable contact 528, the current $I_{HL}$ flows to the output terminal 506 and returns to output terminal 508 to flow back to input terminal 504. Consequently, the current $I_{HL}$ represents the full frequency spectrum, both high and low frequencies components, of the signal generated by the sensors of the string instrument, thereby providing an unfiltered effect to output what is considered a "natural sound." To assist a musician find the intermediate position of the mechanical travel of potentiometers 510 and 520, potentiometers 510 and 520 may incorporate a mechanical detent at the intermediate position of the mechanical travel of the corresponding displaceable contacts 518, 528 to provide a tactile indication thereof. At positions between the first end of the mechanical travel of displaceable contacts 518 and 528, and the intermediate point of their mechanical travel, resistance is added in series with capacitor 540 to reduce the output current $I_H$ and thereby reduce soften the sound output.

Turning now to FIG. 4, the displaceable contacts 518, 528 are set to second end of their respective mechanical travel. At the second end of mechanical travel, the resistance between the terminals 515 and 513, as well as between terminals 506 and 525 of displaceable contacts 518, 528 is respectively zero ohms. Accordingly, there is zero ohms between input terminal 502 and terminal 515, to which one lead of capacitor 530 is connected. By that arrangement, the capacitor 530 is connected across the input terminals 502 and 504 to thereby function as a low pass filter by forming a low impedance path from terminal 502 to terminal 504 and ground 550 for high frequency component signals and a high impedance path for lower frequency component signals. As is well known in the art, the high frequency cutoff frequency is a function of the capacitance value of capacitor 530. Accordingly, a current $I_{HL}$ input to terminal 502 will flow to node 503 where no current flows through the resistive element 511 due to the high resistance thereof. The current $I_{HL}$ thus flows to terminal 513, from which the high frequency component current $I_H$ flows through displaceable contact 518 and through capacitor 530 to node 534.

As the low frequency component of the current cannot pass through capacitor 530, the low frequency component current $I_L$ flows on from terminal 513 to terminal 527 and then to terminal 525. The low frequency component current $I_L$ cannot flow through the capacitor 540 and the high resistance of the resistive element 521. From terminal 525, the low frequency component current $I_L$ flows from terminal 525 through displaceable contact 528 to output terminal 506. The low frequency component current $I_L$ returns to output terminal 508 and flows to node 534, where it combines with the high frequency component current $I_H$. Therefore, the total current $I_{HL}$ flows from node 534 to input terminal 504. Hence, at this position of potentiometers 510 and 520, the mellower low frequency sounds are output. At positions between the second end of the mechanical travel of displaceable contacts 518 and 528, and the intermediate point of their mechanical travel, resistance is added in series with capacitor 530 to reduce the current $I_H$ that is bypassed and a percentage of the high frequency component current that is coupled to the output. Accordingly the output sound is brightened.

Figure 5:
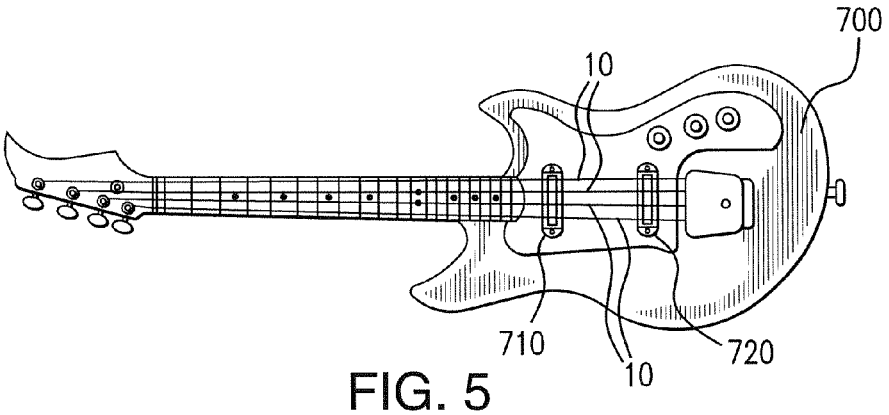
FIG. 5 is an illustration of an electric string instrument showing typical locations of pickup coils for sensing string vibrations.

Turning now to FIG. 5, there is illustrated an exemplary electric string musical instrument 700 in the form of a guitar. As is typical of such musical instruments, guitar 700 includes a plurality of strings 10, the vibrations of which are sensed by the pickup sensors 710 and 720. Although only a single pickup sensor is necessary for the guitar to function as a musical instrument, a broad range and variation of sounds can be generated using multiple pickup sensors. For simplicity, the pickup sensors 710 and 720 will be exemplified as single coil type sensors, however, the tone control circuit 660 is operable with a single Humbucker type pickup or multiple Humbucker pickups with the coils of each pickup combined in series or parallel, either selectably or fixedly.

Figure 6:
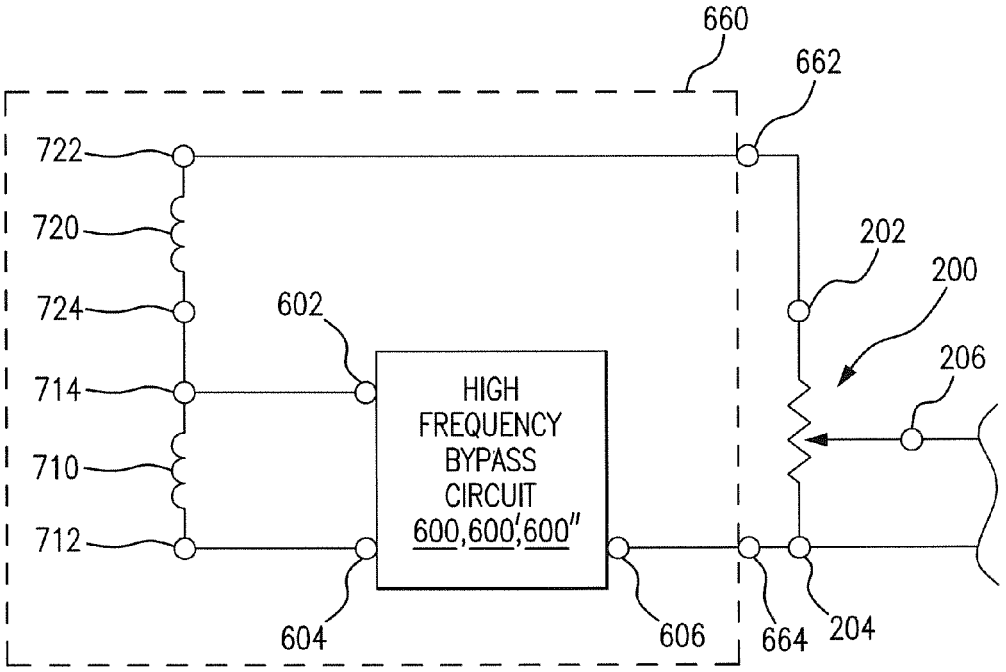
FIG. 6 is a schematic diagram of another tone control for an electric string instrument of the present invention.

The tone control 660, as shown in FIG. 6, combines the pickup coils 710 and 720 with a high frequency bypass circuit 600, 600', 600". The output of tone control 660, from terminals 552 and 664, can be coupled the terminals 202 and 204 of the volume control potentiometer 200. The terminals 204 and 206 of volume control potentiometer 200 would then be connected as shown in FIGS. 1 and 1A. As will be described in following paragraphs, one or more tone control circuits 660 may also be coupled to a master tone control circuit whose output is then connected to the volume control potentiometer 200.

Referring back to FIG. 5, it can be seen that the pickup coil 710 is disposed in close proximity to the neck of guitar 700 and pickup 720 is disposed in close proximity to the bridge of guitar 700. At the position of pickup 720, the strings 10 are more restricted in their vibratory movement that at the position of pickup 710 due to their proximity to the bridge where the strings are seated in grooves of the bridge structure. Since the strings 10 are less restricted at the position of pickup 710 and thereby generate more harmonic frequencies thereat, that are sensed by pickup 710, connecting high frequency bypass circuit to the output of pickup 710 will have a greater effect that if connected to the output of pickup 720. However, it is contemplated that in some instances bypassing of high frequencies output from the pickup closest to the bridge, pickup 720, may be desirable and should be considered an optional configuration for tone control 660.

In the configuration shown in FIG. 6, the pickup sensor coil 720 has terminals 722 and 724; and the pickup sensor coil 710 has terminals 712 and 714. The two pickup coils 710 and 720 are connected in series with the terminal 724 of coil 720 electrically connected to the terminal 714 of coil 710. As discussed above, the pickup coil 710 is coupled to a high frequency bypass circuit 600, 600', 600". The terminal 712 of pickup coil 710 is connected to the input terminal 604 high frequency bypass circuit 600, 600', 600" and the other terminal 714 of pickup coil 719 is coupled to the high frequency bypass circuit input terminal 602. The output of tone control circuit 660 is provided at output terminals 662 and 664. Output terminal 662 is connected to terminal 722 of pickup coil 720 and output terminal 664 is connected to the high frequency bypass circuit output terminal 606.

Figure 7:
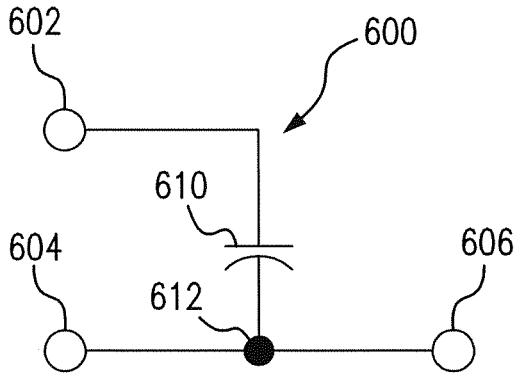
FIG. 7 is schematic electrical diagram of the high frequency bypass circuit shown in FIG. 6.

The high frequency bypass circuit may take several forms. Referring additionally to FIG. 7, the high frequency bypass circuit 600, shown, is the simplest circuit arrangement for filtering high frequency components from the output generated by pickup coil 710 while allowing the high frequency component current from the output generated by pickup coil 720 to bypass the high impedance that the inductance of coil 710 represents to their flow therethrough, by providing a lower impedance path for the high frequency component current. The high frequency bypass circuit 600 includes a capacitor 610 coupled between input terminals 602 and 604. Capacitor 610 is connected to terminal 604 via a node 612 that is also connected to output terminal 606. Thus, the low frequency component currents generated by pickup coils 710 and 720 flows from input terminal 604 to output terminal 606. The high frequency component current generated by pickup coil 720 flows through capacitor 610 to node 612 and from there to output terminal 606. Therefore, by this arrangement, the high frequency components generated by pickup coil 710 are suppressed (essentially shorted) and the high frequency components generated by pickup coil 720 are enhanced over what would be the effect without the current path formed by capacitor 610 (just the two pickup coils coupled in series. The effect of capacitor 610, as to the frequency cutoff the filtering effects is a function of the value of capacitance thereof and the value thereof can be selected accordingly. In working embodiments of high frequency bypass circuit 600, 600', 600", capacitor 610 was chosen to be in the range of 27-68 nF, as a function of the instrument and/or style of music with which it is used, but other values may be used.

Figure 8:
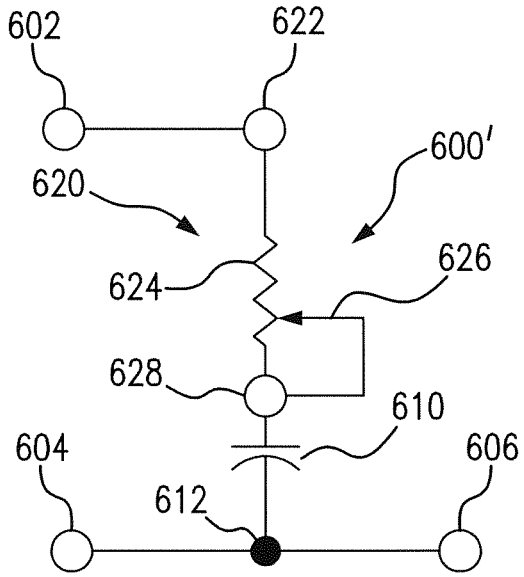
FIG. 8 is a schematic electrical diagram of another configuration of the high frequency bypass circuit shown in FIG. 6.

To provide variation of the filtering effect provided by capacitor 610, the high frequency bypass circuit 600', shown in FIG. 8 may be employed. High frequency bypass circuit 600' differs from high frequency bypass circuit 600 only in the inclusion of a potentiometer 620. In high frequency bypass circuit 600', the input terminal 602 is connected to terminal 622 at one end of the potentiometer 620. Potentiometer 620 has a resistive element 624 connected between terminals 622 and 628, and a displaceable contact 626 which is also connected to terminal 628. The resistive element 624 is connected in series with the capacitor 610, which is connected between terminal 628 of potentiometer 620 and the node 612. The displaceable contact 626 therefore serves to vary the amount of resistance in series with capacitor 610 from 0 to 100 percent of the resistance of resistive element 624. While the value of resistance provided by potentiometer is not critical, and the type of taper thereof is a matter of choice, it has been found that potentiometers having a linear taper with resistances in the range of 250-500 KΩ function satisfactorily. From the circuit diagram, it is readily apparent that adding resistance in series with capacitor 610 mutes its effect on passing the high frequency component currents generated by pickup coils 710 and 720.

Figure 9:
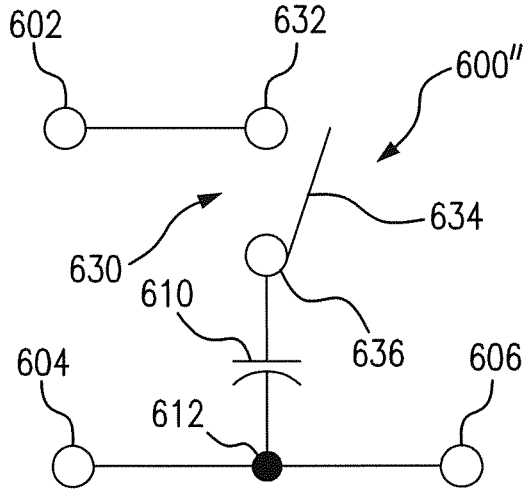
FIG. 9 is a schematic electrical diagram of a further configuration of the high frequency bypass circuit shown in FIG. 6.

To provide the ability to selectively employ the filtering effect provided by capacitor 610 or not, the high frequency bypass circuit 600", shown in FIG. 9 may be utilized. High frequency bypass circuit 600" differs from high frequency bypass circuit 600 only in the inclusion of a switch 630. In high frequency bypass circuit 600", the input terminal 602 is connected to terminal 632 at one end of the switch 630. Switch 630 has a movable switch contact 634 that selectively electrically connects terminal 632 to the terminal 636 thereof. Capacitor 610 is connected between terminal 636 of switch 630 and the node 612. Thus, when the switch is closed, electrically connecting terminal 636 to terminal 632, high frequency bypass circuit 600" functions identically to that of high frequency bypass circuit 600. On the other hand, when switch 630 is in an open condition, isolating capacitor 610 from the input terminal 602, the output of pickup coils 710 and 720 are unfiltered. With the switch open, guitar 700 provides what musicians consider a "rock" sound, where the output includes all of the high frequency components produced by pickup coil 710. When the switch is closed, those high frequency components produced by pickup coil 710 are muted; producing musicians consider a "jazz" sound.

Figure 10:
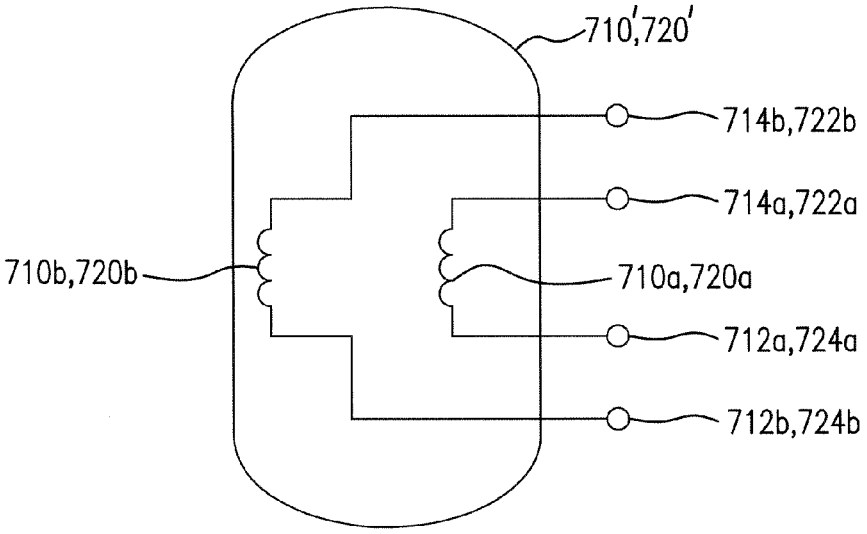
FIG. 10 is a schematic illustration of a Humbucker type pickup sensor for string instruments.

FIG. 10 schematically illustrates the arrangement of a Humbucker type pickup sensor 710', 720' which may respectively replace the pickup sensors 710 and 720 of the guitar 700 shown in FIG. 5. Each pickup 710', 720' includes a pair of coils 710*a*, 720*a* and 710*b*, 720*b*. Coil 710*a*, 720*a* has a pair of terminals 714*a*, 722*a* and 712*a*, 724*a* connected to opposing ends thereof. Similarly, coil 710*b*, 720*b* has a pair of terminals 714*b*, 722*b* and 712*b*, 724*b* connected to its opposing ends. As is known in the art, Humbucker pickups are arranged to be of opposite magnetic and electric polarity so as to produce a differential signal. Since ambient electromagnetic noise affects both coils equally and since the coils are poled oppositely, the noise signals induced in the two coils cancels out. The two coils of a Humbucker are often wired in series to give a fuller and stronger sound. The two coils of a Humbucker type pickup can also be connected in parallel, which results in a brighter sound, albeit with a weaker output, but with the pickup's hum-cancelling properties still being retained.

Figure 11:
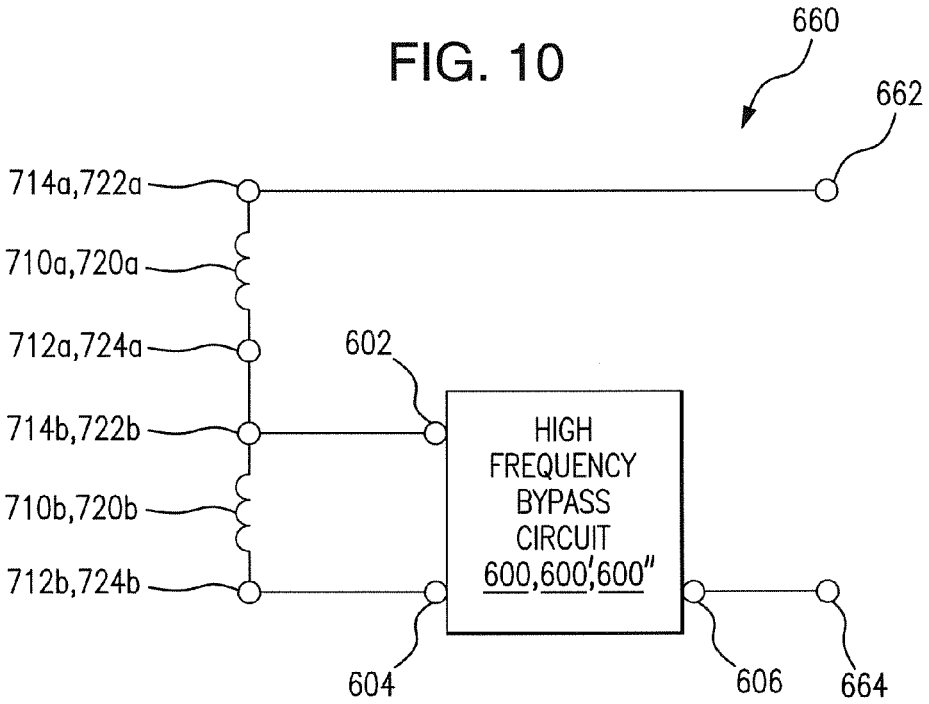
FIG. 11 is a schematic diagram of the tone control shown in FIG. 6 used with the pickup sensor of FIG. 10.
Figure 12:
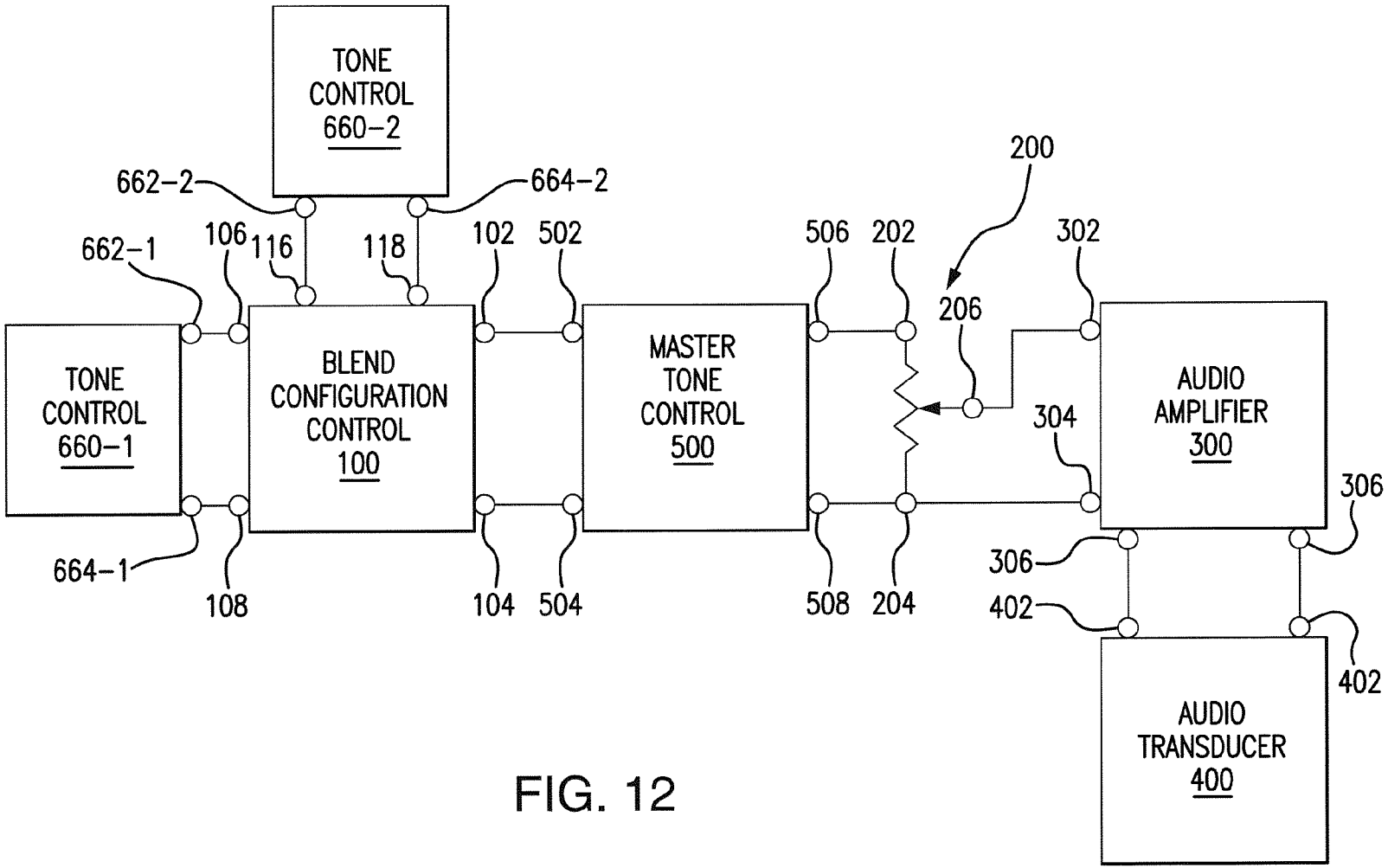
FIG. 12 is block diagram illustrating the basic audio system for an electric string instrument incorporating tone controls of FIG. 6, a tone configuration control and the tone control of FIGS. 2-4.

With the two coils 710*a* and 710*b*; 720*a* and 720*b* coupled in series, each pickup 710' and 720' may be coupled to a corresponding one of two separate tone controls 660, as illustrated in FIGS. 11 and 12. As shown in FIG. 11, the terminal 712*a*, 724*a* of coil 710*a*, 720*a* is coupled to the terminal 714*a*, 722*a* of coil 710*b*, 720*b* to connect the two coils in series. The terminals 714*b*, 722*b* and 712*b*, 724*b* of coil 710*b*, 720*b* are correspondingly coupled to the input terminals 602 and 604 of high frequency bypass circuit 600, 600', 600". The terminal 714*a*, 722*a* of coil 710*a*, 720*a* is connected to the tone control output terminal 662 and the output terminal 606 of high frequency bypass circuit 600, 600', 600" is connected to the tone control output terminal 664. Hereto, the connections of the coils 710*a* and 710*b* and/or 720*a* and 720*b* can be interchanged with respect to which of the two coils is connected the input terminals 602 and 604 of high frequency bypass circuit 600, 600', 600". Alternately, the two coils 710*a* and 710*b*; 720*a* and 720*b* of each of the pickups 710' and 720' may be coupled in parallel relationship and the two paralleled pairs of coils connected series as part of a single tone control circuit 660.

Where each pickup 710' and 720' are separately incorporated in a corresponding tone control 660-1 and 660-2, such may be integrated into an audio system of the string instrument as illustrated in FIG. 12. The outputs of tone control circuits 660-1 and 660-2 for each of the pickups 710' and 720' are combined using a blend configuration control 100, of the type previously described with respect to FIG. 1A. Thus, the output terminals 662-1 and 664-1 of tone control 660-1 are respectively connected to one pair of input terminals 106 and 108 of the blend configuration control 100. Likewise, the output terminals 662-2 and 664-2 of tone control 660-2 are respectively connected to another pair of input terminals 116 and 118 of the blend configuration control 100. Where greater than two pickups are utilized with a string instrument, they can be similarly combined using a blend configuration control circuit configured for combining the corresponding number of pickups being used, as such blend circuits are well known in the art.

The output terminals 102 and 104 of blend configuration control 100 are respectively connected to the input terminals 502 and 504 of tone control 500, previously described with respect to FIGS. 2-4. Tone control 500 now functions as a master tone control to further select high pass filtering, low pass filtering or no filtering independently of the setting of tone controls 660-1 and 660-2. From tone control 500, the signals processed thereby are output to terminals 506, 508 which are respectively connected to terminals 202 and 204 of a volume control 200. The output of volume control 200 provided from terminals 206 and 204 are respectively coupled to terminals 302 and 304 of the audio amplifier 300 that provides an output of increased signal level on terminals 306 connected to the input terminals 402 of audio transducer 400.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A tone control for string instruments comprising a pair of potentiometers each having one end coupled in series relationship with a respective filter capacitor and mechanically coupled one to the other for concurrent mechanical travel of respective displaceable contacts thereof; a first of said pair of potentiometers and said series coupled filter capacitor being connected between a pair of input terminals, said displaceable contact of said first potentiometer being connected in common with a second end of said potentiometer; said filter capacitor coupled in series with said second of said pair of potentiometers being coupled in common with said displaceable contact of said first potentiometer and in common with a second end of said second potentiometer; said displaceable contact of second potentiometer being coupled to an output terminal, wherein a high pass filter is formed at one end of said concurrent mechanical travel, a low pass filter is formed at an opposing end of said concurrent mechanical travel, and an unfiltered path between said input terminals and said output terminal is formed at an intermediate position of said concurrent mechanical travel.

2. The tone control for string instruments as recited in claim 1, where each of said first and second potentiometers has a substantial resistance between said intermediate position and one of said ends of said concurrent mechanical travel of said first and second displaceable contacts and an insignificant resistance between said intermediate position and the other of said ends of said concurrent mechanical travel of said first and second displaceable contacts.

3. The tone control for string instruments as recited in claim 1, where each of said first and second potentiometers has a detent at said intermediate position of said concurrent mechanical travel to provide a tactile indication thereof.

4. The tone control for string instruments as recited in claim 3, where said detent is located at a midpoint of said concurrent mechanical travel.

5. A tone control for string instruments, comprising:

a pair of input terminals coupled to at least one vibration sensing pickup disposed on a string instrument;

a first potentiometer having a first resistive element coupled between first and second terminals thereof and having a first displaceable contact connecting to said first resistive element and a third terminal, said first terminal being coupled to one of said pair of input terminals and said third terminal being electrically coupled to said first terminal of said first potentiometer;

a first filter capacitor having opposing first and second terminals thereof being coupled in series relationship with said first resistive element between said pair of input terminals, one of said first and second terminals of said first filter capacitor being coupled to one of a pair of output terminals;

a second potentiometer having a second resistive element coupled between first and second terminals thereof and having a second displaceable contact, said first and second potentiometers being mechanically coupled for concurrent mechanical travel of said first and second displaceable contacts; and a second filter capacitor having opposing first and second terminals being coupled in series relationship with said second resistive element, said first terminal of said second filter capacitor being electrically connected to said first terminal of said first potentiometer, said second displaceable contact being coupled to the other of said pair of output terminals, said first and second potentiometers thereby providing different filter selections responsive to positioning of said first and second displaceable contacts along said concurrent mechanical travel thereof for (a) forming a high pass filter at one end of said concurrent mechanical travel, (b) forming a low pass filter at an opposing end of said concurrent mechanical travel, and (c) forming an unfiltered path between said pair of input terminals and said pair of output terminals at an intermediate position of said concurrent mechanical travel.

6. The tone control for string instruments as recited in claim 5, where each of said first and second potentiometers has a substantial resistance between said intermediate position and one of said ends of said concurrent mechanical travel of said first and second displaceable contacts and an insignificant resistance between said intermediate position and the other of said ends of said concurrent mechanical travel of said first and second displaceable contacts.

7. The tone control for string instruments as recited in claim 6, where said mechanical travel of said first displaceable contact has first and second end positions and said substantial resistance of said first potentiometer is disposed between said intermediate position and said first end position of said mechanical travel of said first displaceable contact, and said mechanical travel of said second displaceable contact has first and second end positions respectively corresponding to said first and second end positions of said mechanical travel of said first displaceable contact, said substantial resistance of said second potentiometer is disposed between said intermediate position and said second end position of said mechanical travel of said second displaceable contact.

8. The tone control for string instruments as recited in claim 7, where a signal from the vibration sensing pickup is coupled to the other of said pair of output terminals through said second capacitor responsive to said first and second displaceable contacts being disposed at said first end position of a respective mechanical travel thereof.

9. The tone control for string instruments as recited in claim 7, where a signal from the vibration sensing pickup is coupled between said pair of input terminals through said first capacitor responsive to said first and second displaceable contacts being disposed at said second end position of a respective mechanical travel thereof.

10. The tone control for string instruments as recited in claim 7, where a signal from the vibration sensing pickup is coupled to the other of said pair of output terminals with said first and second capacitors being effectively bypassed responsive to said first and second displaceable contacts being disposed at said intermediate position of a respective mechanical travel thereof.

11. The tone control for string instruments as recited in claim 6, where a signal from the vibration sensing pickup is coupled to the other of said pair of output terminals through said second capacitor responsive to said first and second displaceable contacts being disposed at said one end of said concurrent mechanical travel.

12. The tone control for string instruments as recited in claim 6, where a signal from the vibration sensing pickup is coupled between said pair of input terminals through said first capacitor responsive to said first and second displaceable contacts being disposed at said opposing end of said concurrent mechanical travel.

13. The tone control for string instruments as recited in claim 6, where a signal from the vibration sensing pickup is coupled to the other of said pair of output terminals with said first and second capacitors being effectively bypassed responsive to said first and second displaceable contacts being disposed at said intermediate position of said concurrent mechanical travel.

14. The tone control for string instruments as recited in claim 5, where each of said first and second potentiometers has a detent at said intermediate position of said concurrent mechanical travel to provide a tactile indication thereof.

15. The tone control for string instruments as recited in claim 14, where said detent is located at a midpoint of said concurrent mechanical travel.

16. The tone control for string instruments as recited in claim 14 where each of said first and second potentiometers has a detent at said intermediate position of said concurrent mechanical travel to provide a tactile indication thereof.

17. The tone control for string instruments as recited in claim 5, where a signal from the vibration sensing pickup is coupled to the other of said pair of output terminals through said second capacitor responsive to said first and second displaceable contacts being disposed at said one end of said concurrent mechanical travel.

18. The tone control for string instruments as recited in claim 5, where a signal from the vibration sensing pickup is coupled between said pair of input terminals through said first capacitor responsive to said first and second displaceable contacts being disposed at said opposing end of said concurrent mechanical travel.

19. The tone control for string instruments as recited in claim 5, where a signal from the vibration sensing pickup is coupled to the other of said pair of output terminals with said first and second capacitors being effectively bypassed responsive to said first and second displaceable contacts being disposed at said intermediate position of said concurrent mechanical travel.

20. A tone control for string instruments comprising:

a pair of pickup coils disposed on a string instrument for inducing voltages therein responsive to vibration of at least one string of the string instrument, said pair of pickup coils being coupled in series relationship; and a high frequency bypass circuit coupled in parallel with one of said pair of pickup coils for filtering signals from said pair of pickup coils, said high frequency bypass circuit including a capacitor configured to be connected in parallel relationship with said one of said pair of pickup coils to form a low pass filter for said one of said pair of pickup coils and a high pass filter for the other of said pair of pickup coils.

21. The tone control as recited in claim 20 where said high frequency bypass circuit further includes a variable resistor coupled in series with said capacitor to vary an effect of filtering provided by said capacitor.

22. The tone control as recited in claim 20 where said high frequency bypass circuit further includes a switch coupled in series with said capacitor to selectively coupling said capacitor to said one of said pair of pickup coils.

23. The tone control as recited in claim 20 where said one of said pair of pickup coils is disposed proximate to a neck portion of the string instrument.

* * * * *